US011578720B2

(12) United States Patent
Hebisch

(10) Patent No.: US 11,578,720 B2
(45) Date of Patent: Feb. 14, 2023

(54) PUMP ASSEMBLY FOR A VEHICLE, AND CONTROL SYSTEM FOR A PUMP ASSEMBLY AND METHOD

(71) Applicant: HANON SYSTEMS EFP DEUTSCHLAND GMBH, Bad Homburg v. d. Höhe (DE)

(72) Inventor: Waldemar Hebisch, Taunusstein (DE)

(73) Assignee: HANON SYSTEMS EFP DEUTSCHLAND GMBH, Bad Homburg v. d. Höhe (DE)

( * ) Notice: Subject to any disclaimer, the term of this patent is extended or adjusted under 35 U.S.C. 154(b) by 76 days.

(21) Appl. No.: 16/960,168

(22) PCT Filed: Nov. 20, 2018

(86) PCT No.: PCT/EP2018/081940
§ 371 (c)(1),
(2) Date: Jul. 6, 2020

(87) PCT Pub. No.: WO2019/137672
PCT Pub. Date: Jul. 18, 2019

(65) Prior Publication Data

US 2020/0355183 A1 Nov. 12, 2020

(30) Foreign Application Priority Data

Jan. 9, 2018 (DE) ..... 10 2018 200 225.8

(51) Int. Cl.
*F04C 14/24* (2006.01)
*F04C 11/00* (2006.01)
(Continued)

(52) U.S. Cl.
CPC ..... *F04C 14/24* (2013.01); *F04B 41/06* (2013.01); *F04C 11/00* (2013.01); *F04C 14/065* (2013.01);
(Continued)

(58) Field of Classification Search
CPC ..... F04C 11/00; F04C 14/065; F04C 14/24; F04C 14/28; F04C 15/0057; F04C 15/008;
(Continued)

(56) References Cited

U.S. PATENT DOCUMENTS 6,017,202 A * 1/2000 Durnack ..... F04C 14/04 418/32
8,714,942 B2 5/2014 Lutoslawski et al.
(Continued)

FOREIGN PATENT DOCUMENTS

DE 10259894 A1 7/2003
DE 102006048050 A1 4/2008
(Continued)

OTHER PUBLICATIONS

English Translation of DE-102016218186-A1 (Year: 2016).*
(Continued)

*Primary Examiner* — Connor J Tremarche
(74) *Attorney, Agent, or Firm* — Harness, Dickey & Pierce, P.L.C.

(57) ABSTRACT

The disclosure relates to a pump assembly for a vehicle having an internal combustion engine with or without transmission or electric motor with transmission or for an oil supply having a double-pipe pump, wherein the two pipes are separated from each other and a second pipe can be connected to a first pipe, wherein the pump has at least one input drive point for an electric machine and also for a drive motor, including, for example, via a gearbox.

19 Claims, 3 Drawing Sheets

Figure 1A:
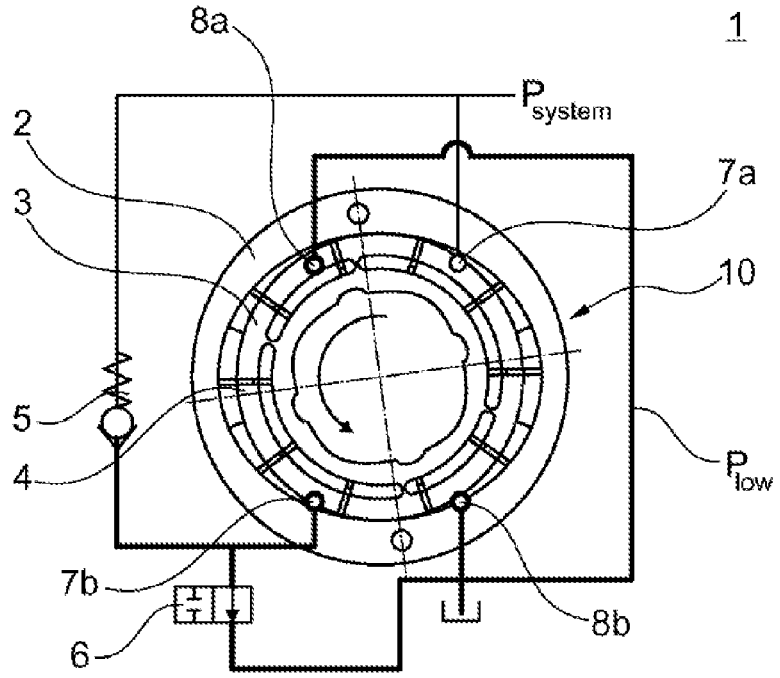

(51) Int. Cl.

| | |
|---|---|
| ***F04C 15/00*** | (2006.01) |
| ***F04C 14/06*** | (2006.01) |
| ***F04C 14/28*** | (2006.01) |
| ***F04B 41/06*** | (2006.01) |

(52) U.S. Cl.
CPC ..... *F04C 14/28* (2013.01); *F04C 15/008* (2013.01); *F04C 15/0057* (2013.01); *F04C 2240/40* (2013.01); *F04C 2270/051* (2013.01)

(58) Field of Classification Search
CPC . F04C 41/06; F04C 2240/40; F04C 2270/051
See application file for complete search history.

(56) References Cited

U.S. PATENT DOCUMENTS 9,217,431 B2 12/2015 Schulz-Andres et al.
2009/0027814 A1* 1/2009 Meid ..... H02H 7/0833 361/31
2011/0030363 A1* 2/2011 Lech ..... F04B 49/002 60/422
2012/0275945 A1* 11/2012 Schulz-Andres ..... F04C 15/06 418/5
2017/0058895 A1* 3/2017 Schultz ..... F04C 15/0073
2018/0066655 A1* 3/2018 Kowalski ..... F04C 2/102

FOREIGN PATENT DOCUMENTS

DE 102016218186 A1 * 3/2018
WO WO-03056180 A1 * 7/2003 ..... F01C 21/0863
WO 2011042105 A2 4/2011

OTHER PUBLICATIONS

English Translation of WO-03056180-A1 obtained Oct. 27, 2022 (Year: 2003).*
Office Action (with English translation) regarding corresponding Korean Application No. 102020702139.5, dated May 26, 2021.

* cited by examiner

| | Electric motor | Internal combustion engine/transmission | Switching valve |
|---|---|---|---|
| Single flow operation | Setpoint rotational speed $DZ_{EMot}$ | Rotational speed $DZ_{VKM}$ =0 or < $DZ_{EMot}$ | open |
| Double flow operation | $DZ_{EMot}$ < $DZ_{VKM}$ or =0 | Rotational speed $DZ_{VKM}$ | closed |
| | | | |

PUMP ASSEMBLY FOR A VEHICLE, AND CONTROL SYSTEM FOR A PUMP ASSEMBLY AND METHOD

CROSS-REFERENCE TO RELATED APPLICATIONS

This application is a U.S. National Phase application under 35 U.S.C. 371 of International Application No. PCT/EP2018/081940, filed Nov. 20, 2018, which claims the benefit of German Patent Application No. 10 2018 200 225.8, filed Jan. 9, 2018. The entire disclosures of each of the above applications are incorporated herein by reference.

FIELD

The disclosure relates to a pump assembly for a vehicle with a drive unit with a double flow pump, the two flows being separate from one another, and it being possible for a second flow to be added to a first flow, the pump having an input point both for an electric machine. Furthermore, the disclosure relates to a control system for the pump assembly and to a method for the operation thereof.

BACKGROUND

This section provides background information related to the present disclosure which is not necessarily prior art.

The reduction of the fuel consumption in the case of vehicles will be a central development focus in the automotive industry in the future. In addition to the development of novel technologies, the optimization of existing components is given an increasing significance. Here, significant saving potentials can be realized, without the immense costs which novel systems can cause. The keywords here are "demand-oriented auxiliary units".

The oil pump is one example and is an important constituent part of the engine and the transmission. A malfunction of the pump leads within a very short time to the failure of the complete assembly. The oil pump has to overcome the three tasks: lubricating, cooling, controlling of various hydraulic actuating elements. Said actuating elements are actuated from the engine control unit. The pressure which is necessary for this purpose is to be provided by the oil pump.

It is generally known that the viscosity of oils drops greatly as the temperature increases. The consequence of this is a corresponding increase in the necessary volumetric flow as the temperature rises, in order to make the build up of the required pressure possible. In order for it to be possible for a volumetric flow to be changed in a manner which is dependent on the temperature, there are in principle two different approaches. Either the rotational speed or the delivery volume of the pump is regulated in a manner which is dependent on the temperature. The pump can also be of stepped configuration instead of a variable adjustment of the delivery volume.

Here, the double flow switching pump is one proven embodiment. This is a double action vane cell pump, in the case of which the outlets can be separated, with the result that two flows arise. Below the switching temperature, one of the two flows is switched into the circulation to the suction duct. The volumetric flow of the second flow is also fed to the system pressure only after the valve is switched. On account of the motor design, it was appropriate in the prior art for the pump to be designed in such a way that it conveys only one flow in normal driving operation ($T_{oil}$<90° C.).

The purely mechanical drive of pumps of this type makes the pump output dependent to a certain extent on the rotational speed of the engine and/or transmission, and loads the energy balance of the internal combustion engine.

A purely electric drive is of course also possible, which presupposes powerful and therefore complex electric motors, however.

Pump assemblies as in DE 10 2006 048 050 A1 are likewise known from the prior art, a first mechanical drive and a second electric drive being assigned to the same pump. U.S. Pat. No. 8,714,942 B2 has disclosed one exemplary embodiment of a dual-drive pump with a reduction gear mechanism.

SUMMARY

This section provides a general summary of the disclosure, and is not a comprehensive disclosure of its full scope or all of its features.

It is an object of the disclosure to provide a pump assembly, a control system for the pump assembly, and a method for operating the pump assembly, which can be adapted simply to different volume requests in a flexible manner and reduces the load of the internal combustion engine.

Here, the object is achieved by way of a pump assembly for a vehicle with a drive unit with a double flow pump, the two flows being separate from one another, and it being possible for a second flow to be added to a first flow, the pump having an input point both for an electric machine and for the drive unit, the electric machine being dimensioned for driving the pump with the first flow and running at a rotational speed above the highest rotational speed of the drive unit.

By way of the normal operation via the first flow and the optimum swapping of the electric machine, the internal combustion engine is not loaded, and the electric machine has to be dimensioned merely for the normal operation and/or merely for start-stop operation. The drive unit, for example an internal combustion engine, can have a direct or indirect input here.

Therefore, the first flow is designed for the normal operation of the pump and/or merely for start-stop operation of the pump.

At least one switching valve is advantageously attached between the flows.

For implementation purposes, in each case one freewheel is arranged at the input points, as a result of which only the machine which is rotating more rapidly always drives the pump.

The object is achieved by way of a control system for a pump assembly, the following steps being controlled:
requesting of a throughflow of the working fluid, which throughflow is required via the normal flow, in the case of a running internal combustion engine, opening of the switching valve, reducing of the rotational speed of the electric machine.

The opening of the switching valve and the reducing of the rotational speed of the electric machine advantageously take place at the same time.

It is advantageous that, in the case of the internal combustion engine being switched off via the start-stop automatic system or in the case of gliding, the rotational speed of the electric machine is set again to the high normal value.

The object is also achieved by way of a method for operating a pump assembly and a control system, the requesting of a throughflow of the working fluid, which throughflow is required via the normal flow, taking place by a vehicle control system in the case of a running internal combustion engine, the switching valve being opened by a central control system or a pump assembly control system, and the rotational speed of the electric machine being turned down.

It is advantageous that the rotational speed of the electric machine is controlled to be between zero and the normal rotational speed, in a manner which is dependent on the number of flows which are switched into the active state.

Furthermore, it is advantageous that the electric machine is switched off by way of an overcurrent protection means.

DRAWINGS

The drawings described herein are for illustrative purposes only of selected embodiments and not all possible implementations, and are not intended to limit the scope of the present disclosure.

In the following text, the disclosure will be described by way of example with reference to the appended drawing.

Figure 1B:
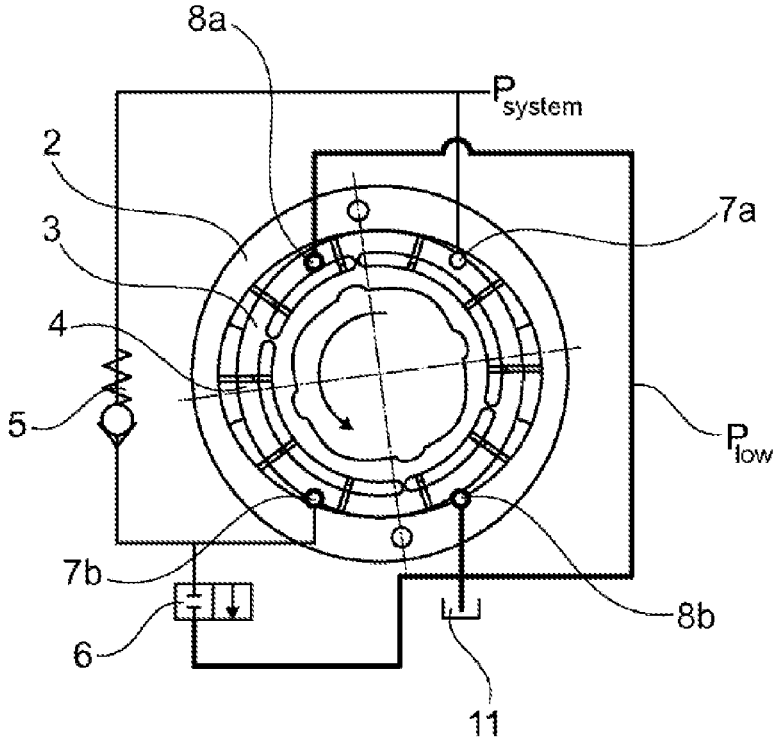
Figures 2, 3:
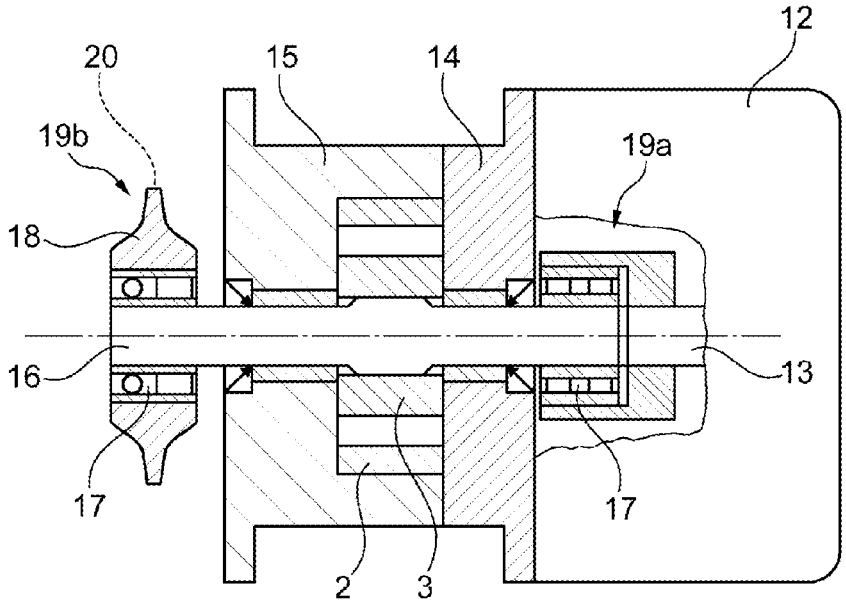
Figure 4:
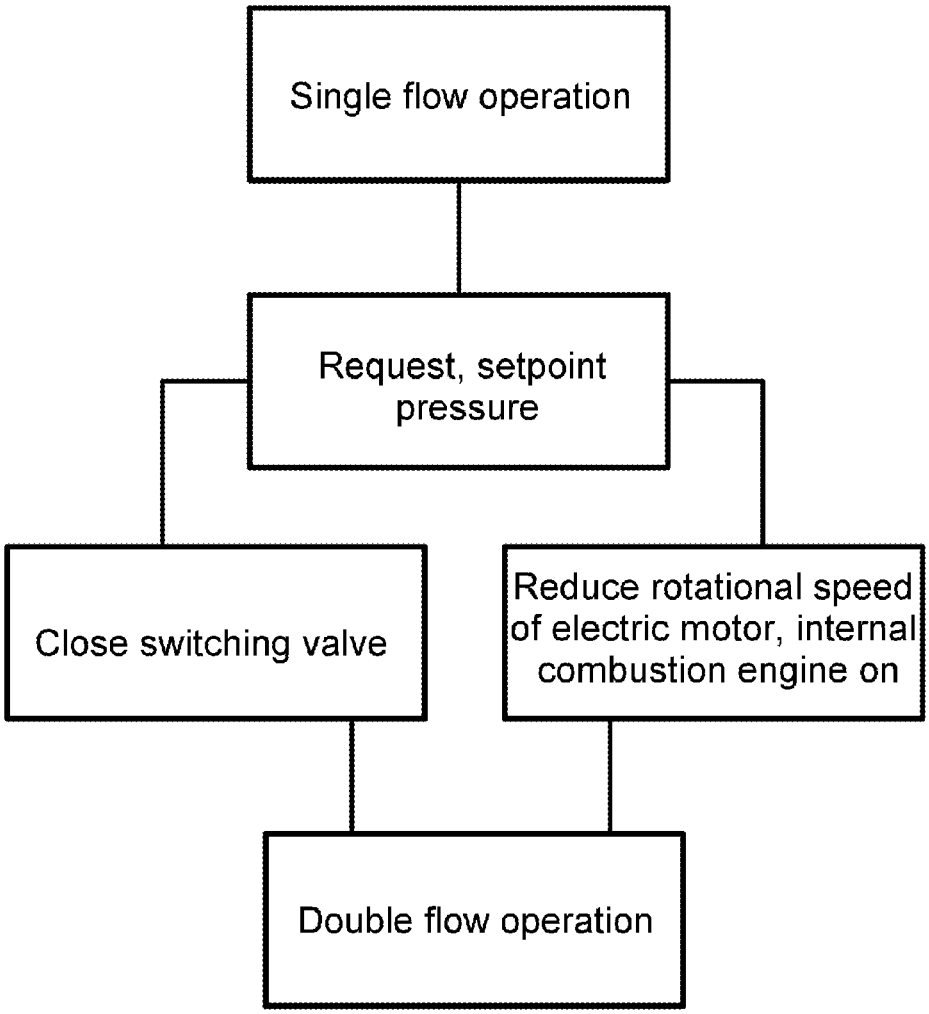

FIG. 1 shows a diagrammatic illustration of an exemplary pump assembly of a switching pump, FIG. 2 shows one exemplary embodiment of a dual-driven switching pump, FIG. 3 shows a switching diagram, and FIG. 4 diagrammatically shows the method for operating a pump assembly.

Corresponding reference numerals indicate corresponding parts throughout the several views of the drawings.

DETAILED DESCRIPTION

Example embodiments will now be described more fully with reference to the accompanying drawings.

FIGS. 1*a* and 1*b* show a pump assembly 1 with a pump 10 in a diagrammatic and exemplary manner.

The rotor group 3 is configured as a double action vane cell with a plurality of vanes 4 which rotate in a cam ring 2. The first flow has a suction region 8*a* and a pressure region 7*a*, whereas the second flow has a suction region 8*b* and a pressure region 7*b*. The construction of the pump itself is configured in such a way that the duct routing is optimum for the normal set state, by only one flow, the first flow, conveying the operating fluid.

The pressure regions 7*a* and 7*b* of the two flows are attached to the pressure region of the system at a system high pressure $P_{system}$. The two suction regions 8*a* and 8*b* in turn are connected to the low pressure region of the pump assembly at a pressure $P_{low}$. A check valve 5 prevents a connection between a high pressure region and a low pressure region between the two flows. A switching valve adds the pressure region 7*b* of the second flow to the pressure region 7*a* of the first flow.

In the case of normal operation of the first flow as shown in FIG. 1*a*, the second flow is connected to a tank 11 via the open switching valve, a poppet valve. The connection between the second flow and the pressure output on the system side is closed by way of the check valve 5. If there is a request for increased pressure or increased volume, the switching valve 6 closes the connection between the pressure output of the second flow and the tank 11. A pressure is built up at the pressure output 7*b* as a result. As soon as the pressure exceeds the system pressure, the check valve is opened and the second flow additionally delivers into the system.

The pump assembly 1 therefore consists of the actual pump with its drives and hydraulic connections, at least one control system and at least one switching valve.

One example of a pump which has a dual drive is described in FIG. 2. In said embodiment, the exemplary pump 10 is arranged between an electric machine 12 and a mechanical attachment. The electric machine 12 has a shaft 13 which is connected to a pump shaft 16 or else is configured in one piece. The rotor group 3 which rotates together with the rotor in the cam ring 2 is seated on the pump shaft. Here, the pump shaft is mounted between a pressure plate 14 and a pump flange 15. The mechanical drive takes place via a drive pinion 18 which is likewise attached on the pump shaft. A freewheel is provided between the pump pinion 18 and the pump shaft 16: a freewheel is likewise installed between the shaft of the electric machine 12 and the pump shaft.

The pump can be attached on an engine block or on the transmission of a vehicle, the crankshaft or a drive gear of the transmission driving the drive pinion 18. A drive via a chain drive is also possible. The drive unit 20 can be an internal combustion engine or an electric machine on its own or a hybrid drive.

Vane cell pumps can also be of asymmetrical configuration, with the result that the first flow can be correspondingly small whereas the second flow which can be added is greater.

The diagram of FIG. 3 describes the operation of the pump in the system according to the disclosure. In normal operation, the pump is operated by way of the electric machine 12. Here, the pump operates in single flow operation. As a result of the two freewheels 17 at the two input points, that drive which rotates at the higher rotational speed is always active. Therefore, if it is desired to relieve the internal combustion engine from the drive of the pump in normal operation, the rotational speed of the electric machine is fixed at a higher value. As a result, the drive pinion is decoupled, and the pump is operated in a purely electric manner. Here, the switching valve which is indicated in the diagram of FIG. 1 is open, and the second flow operates in a pressureless manner.

Since the pump operates in a purely electric manner in normal operation, operation during gliding operation or at a standstill of the internal combustion engine is readily possible.

Should the system of the vehicle require a higher pressure and/or a higher volumetric throughput, the pump is switched over to double flow operation, in which the switching valve is closed.

Since the electric machine 12 can then no longer supply sufficient power, since it is dimensioned only for normal operation, the internal combustion engine has to be switched on.

To this end, the rotational speed of the electric machine is reduced or set to 0, to such an extent that the drive pinion is drive-connected to the rotor shaft. The electric machine is decoupled via the freewheel 17.

FIG. 4 diagrammatically shows the method for operating a pump assembly.

Starting from single flow operation which can be realized even without the internal combustion engine, the system receives a request to increase the setpoint pressure.

The control system of the pump assembly closes the switching valve 6. The rotational speed of the electric machine is reduced, and the internal combustion engine is switched on or is already running. The two steps, namely the closing of the switching valve and the reducing of the rotational speed of the electric machine, can take place at the same time or at staggered intervals with respect to one another. Double flow operation results from closing of the switching valve. The internal combustion engine is coupled to the pump by way of reducing of the rotational speed of the electric machine and the decoupling of the electric machine by way of the freewheels.

The disclosure can be used for a very wide variety of embodiments as a pump assembly on an internal combustion engine with or without a transmission, and also an electric machine as a sole drive or additional drive with or without a transmission with a transmission. The disclosure can also be used for an oil supply.

The foregoing description of the embodiments has been provided for purposes of illustration and description. It is not intended to be exhaustive or to limit the disclosure. Individual elements or features of a particular embodiment are generally not limited to that particular embodiment, but, where applicable, are inter-changeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. A pump assembly for a vehicle with a drive unit, comprising;

a singular double flow pump, the two flows being separate from one another, and it being possible for a second flow to be added to a first flow, the pump having a first input point for an electric machine and a second input point for the drive unit, wherein the electric machine is dimensioned for driving the pump with the first flow and runs at a single flow rotational speed above a highest rotational speed of the drive unit; and a switching valve attached between the first flow and the second flow, wherein when the switching valve is opened, the rotational speed of the electric machine is set to the single flow rotational speed above the highest rotational speed of the drive unit, and when the switching valve is closed, the rotational speed of the electric machine is reduced to zero or to a rotational speed lower than a rotational speed of the drive unit.

2. The pump assembly as claimed in claim 1, wherein the first flow is designed for a single flow operation of the pump.

3. The pump assembly as claimed in claim 1, wherein a first freewheel is arranged at the first input point and a second freewheel is arranged at the second input point.

4. A control system for a pump assembly as claimed in claim 2, comprising:

requesting of a throughflow of a working fluid, which throughflow is required via the single flow, in an event of a running drive unit, closing of the switching valve, and reducing of the rotational speed of the electric machine.

5. The control system as claimed in claim 4, wherein the closing of the switching valve and the reducing of the rotational speed of the electric machine take place at the same time.

6. The control system as claimed in claim 4, wherein in an event of the drive unit being switched off via a start-stop automatic system or in an event of gliding, the rotational speed of the electric machine is set again to the single flow rotational speed.

7. A method for operating a pump assembly and a control system as claimed in claim 2, wherein a requesting of a throughflow of a working fluid, which throughflow is required via the single flow, takes place by a vehicle control system in an event of a running drive unit, in that the switching valve is closed by a central control system or a pump assembly control system, and in that the rotational speed of the electric machine is reduced.

8. The method as claimed in claim 7, wherein the rotational speed of the electric machine is controlled to be between zero and the single flow rotational speed, in a manner which is dependent on a number of flows which are switched into an active state.

9. The method as claimed in claim 7, wherein the electric machine is switched off by way of an overcurrent protection means.

10. The pump assembly as claimed in claim 1, wherein the singular double flow pump includes two spaced apart suction regions and two spaced apart pressure regions in fluid communication with a common fluid chamber.

11. A pump assembly for a vehicle with a drive unit, comprising:

a double flow pump, the two flows being separate from one another, and it being possible for a second flow to be added to a first flow, the pump having a first input point for an electric machine and a second input point for the drive unit, wherein both of the drive unit and the electric machine drive the pump in the same rotational direction, wherein the electric machine is dimensioned for driving the pump with the first flow and runs at a single flow rotational speed above a highest rotational speed of the drive unit; and a switching valve attached between the first flow and the second flow, wherein when the switching valve is opened, the rotational speed of the electric machine is set to the single flow rotational speed above the highest rotational speed of the drive unit, and when the switching valve is closed, the rotational speed of the electric machine is reduced to zero or to a rotational speed lower than a rotational speed of the drive unit.

12. The pump assembly as claimed in claim 11, wherein the first flow is designed for a single flow operation of the pump.

13. The pump assembly as claimed in claim 11, wherein a first freewheel is arranged at the first input point and a second freewheel is arranged at the second input point.

14. A control system for a pump assembly as claimed in claim 12, comprising:

requesting of a throughflow of a working fluid, which throughflow is required via the single flow, in an event of a running drive unit;

closing of the switching valve; and reducing of the rotational speed of the electric machine.

15. The control system as claimed in claim 14, wherein the closing of the switching valve and the reducing of the rotational speed of the electric machine take place at the same time.

16. The control system as claimed in claim 14, wherein in an event of the drive unit being switched off via a start-stop automatic system or in an event of gliding, the rotational speed of the electric machine is set again to the single flow rotational speed.

17. A method for operating a pump assembly and a control system as claimed in claim 12, wherein a requesting of a throughflow of a working fluid, which throughflow is required via the single flow, takes place by a vehicle control system in an event of a running drive unit, in that the switching valve is closed by a central control system or a pump assembly control system, and in that the rotational speed of the electric machine is reduced.

18. The method as claimed in claim 17, wherein the rotational speed of the electric machine is controlled to be between zero and the single flow rotational speed, in a manner which is dependent on a number of flows which are switched into an active state.

19. The method as claimed in claim 17, wherein the electric machine is switched off by way of an overcurrent protection means.

* * * * *